United States Patent [19]

Brüggen et al.

[11] Patent Number: 4,843,951

[45] Date of Patent: Jul. 4, 1989

[54] SERVOCYLINDER WITH AN ELECTRIC PISTON STROKE LIMITING SWITCH

[75] Inventors: Gerhard Brüggen, Stuttgart; Manfred Gaugler, Freiberg; Dieter Karr, Berling; Josef Winkler, Gerlingen, all of Fed. Rep. of Germany

[73] Assignee: Robert Bosch GmbH, Stuttgart, Fed. Rep. of Germany

[21] Appl. No.: 130,877

[22] PCT Filed: Jan. 14, 1987

[86] PCT No.: PCT/DE87/00013

§ 371 Date: Oct. 6, 1987

§ 102(e) Date: Oct. 6, 1987

[87] PCT Pub. No.: WO87/04763

PCT Pub. Date: Aug. 13, 1987

[30] Foreign Application Priority Data

Feb. 8, 1986 [DE] Fed. Rep. of Germany ..... 3603992

[51] Int. Cl.[4] ..... F01B 25/26; F01B 31/12

[52] U.S. Cl. ..... 92/5 R; 91/25; 91/42; 310/339; 251/129.06

[58] Field of Search ..... 92/5, 15; 91/25, 42, 91/43, 405, 408, 409, 410, 361, 363 R, 459, 275; 310/339, 328; 251/129.06

[56] References Cited

U.S. PATENT DOCUMENTS

| | | | |
|---|---|---|---|
| 2,975,119 | 3/1961 | Emmons | 92/15 |
| 2,983,922 | 5/1961 | Juilfs | 92/15 |
| 3,027,876 | 4/1962 | Strick | 92/15 |
| 3,598,506 | 10/1971 | O'Neill | 310/339 |
| 3,758,827 | 9/1973 | Schroder et al. | 310/339 |
| 4,584,980 | 4/1986 | Weiger et al. | 251/129.06 |
| 4,610,426 | 9/1986 | Brandner | 251/129.06 |

FOREIGN PATENT DOCUMENTS

| | | |
|---|---|---|
| 1306756 | 9/1962 | France . |
| 2087659 | 5/1982 | United Kingdom . |

OTHER PUBLICATIONS

"Piezoelectric Ceramic Transducers", Electronic Design, 9/74.

*Primary Examiner*—Robert E. Garrett
*Assistant Examiner*—Thomas Denion
*Attorney, Agent, or Firm*—Michael J. Striker

[57] ABSTRACT

A servocylinder (1, 3, 4) with an electric piston end position transmitter is suggested. It is constructed as a piezoelectric converter (17 and 18). By means of applying voltage to the piezoelectric converter (17 and 18) the latter becomes a regulating element which overcomes a force holding the piston (2) in its stroke end position and removes the piston (2) from its position in which the feed line (7 and 8) of the pressure medium is sealed.

13 Claims, 1 Drawing Sheet

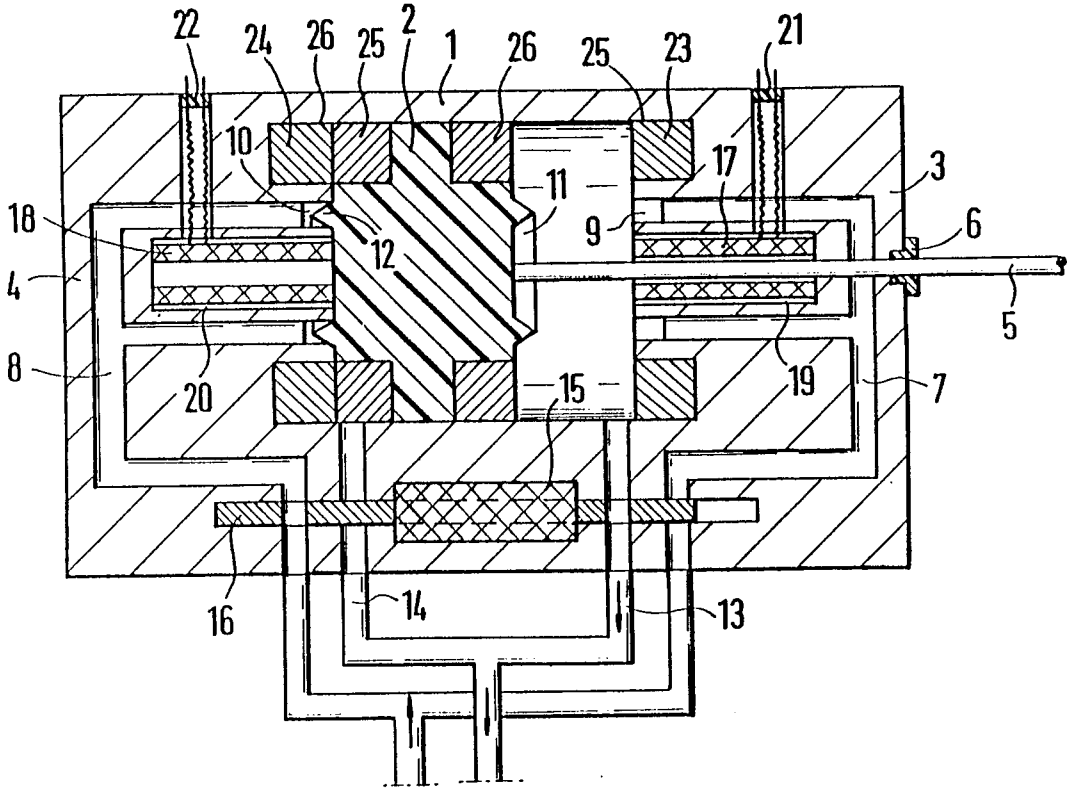
5
6
3
7
21
19
17
23
13
25
9
11
15
26
1
2
12
14
25
26
24
10
16
22
20
18
4
8

SERVOCYLINDER WITH AN ELECTRIC PISTON STROKE LIMITING SWITCH

PRIOR ART

The invention is based on a servocylinder according to the preamble of claim 1. Arrangements of this kind are already known. They are constructed as single-acting or double-acting cylinders whose pistons can be acted upon by liquids or gases, particularly compressed air. The inlet and outlet of the pressure medium is controlled in such a way that the previous inlet is closed and the outlet is opened when the stroke end position of the piston is reached. Varous possibilities are known for measuring and determining the position of the piston of a servocylinder, particularly that in which the piston end position is reached. But all these known arrangements are relatively expensive, susceptible to interference or inaccurate. Thus, for example, a servocylinder, which is known from DE-PS No. 30 14 331, uses a diaphragm as an end position transmitter, which diaphragm is welded with the front wall of the cylinder and consists of high-grade steel, an actuating member which is carried by the piston is axially aligned with the diaphragm. The deformation of the diaphragm is converted into a position signal by means of a sensing device arranged outside the cylinder space. DE-OS No. 32 21 574 is concerned with a cylinder with an integrated electric signal transmitter which, in one embodiment form, comprises two insulated electric conductors which are held at different electric potentials and contact the piston surface in the stroke end position, the piston surface consisting of a conductive material.

ADVANTAGES OF THE INVENTION

In contrast, the servocylinder, according to the invention, with the characterizing features of claim 1, has the advantage that it detects the end position of the piston without movable parts and with a compact construction. With a tight sealing of the working space, an indication of the end position of the piston is achieved with accurate response time; this also functions in a reliable manner under heavy-duty use conditions, at high pressures and temperatures, and is practically free of wear. Moreover, an external voltage source for indicating the end position of the piston is dispensable. In addition, the aforementioned servocylinder can be further developed as a piezo-hydraulic or piezo-pneumatic regulating element distinguished by large regulating distances, short regulating times and large transmission of force. For this purpose, it is provided that the feed line for a pressure medium acting upon the piston open into the front wall of the cylinder, the feed line being sealed in the stroke end position by means of a portion of the end face of the piston, that the piston be held in its stroke end position by means of a force which is greater than force of the pressure medium acting on the partial surface of the piston, and that a piezoelectric converter, which is connectable with a voltage source, be arranged in the front wall of the cylinder, which converter expands in the displacement direction of the piston when voltage is applied and lifts its end face from the front wall of the cylinder. According to an advantageous embodiment form of the invention, a joint piezoelectric converter is provided for detecting the piston end position and for lifting the piston from the front wall of the cylinder. This converter is advisably constructed as a cylindrical member which is inserted in a borehole of the front wall of the cylinder, which borehole extends in the movement direction of the piston.

DRAWING

An embodiment example of the invention is shown in the drawing and explained in more detail in the following description accompanied by the presentation of other advantages. The drawing shows a schematic presentation of a servocylinder with the respective control devices in a longitudinal section.

DESCRIPTION OF THE EMBODIMENT EXAMPLE

The drawing shows a servocylinder 1 with a piston 2 which is acted upon on both sides, is reciprocated along a linear stroke distance and can be reversed after its end positions are reached. The cylinder 1 is closed on both sides so as to be sealed against pressure by means of a cylinder cover 3 and 4. The cylinder covers are shown as forming one piece with the servocylinder 1 for the sake of clarity. The piston 2 has a piston rod 5 which is guided in an outward direction through a borehole in the cover 3, which borehole is provided with a seal 6.

The pressure medium is fed to the interior space of the cylinder along lines 7 and 8, which are constructed in the cylinder covers 3, 4. In the area of the front walls of the cylinder covers, which front walls face one another, the lines are constructed as annular spaces 9 and 10 with which the sealing rings 11 and 12 located at the end faces of the piston 2 cooperate. Return lines 13 and 14, which open into the cylinder space in the vicinity of the front walls of the cylinder covers 3 and 4, are provided for guiding away the pressure medium located in the cylinder. The lines contain a control slide 16 which is actuable by means of an electromagnet 15. Depending on the position of this slide, either the feed line 8 and the drain line 14, or the feed line 7 and the drain line 13, are released.

The signal for the reversing of the control slide 16 is generated by means of piston end position transmitters which are arranged in or at the cylinder covers 3, 4 and are actuated in the stroke end position by means of the piston 2. Piezoelectric converters 17 and 18 are used as such end position transmitters. The latter are constructed in the embodiment example as cylindrical hollow members which are inserted in a borehole 19 and 20 of the cover 3 and 4, which borehole is centrically arranged and extends in the movement direction of the piston. The hollow members project over the front wall of the covers by several micrometers in the unloaded state. The hollow member 17 is penetrated by the piston rod 5. Each converter consists of a plurality of piezoelectric perforated disks which are layered one on top of the other and are arranged in a housing of insulating material. The disks are electrically connected so as to be parallel. Each converter is connected with the electromagnet 15 by means of an outwardly guided line 21 and 22.

The piston 2 is held in its respective end stroke position by means of a force which is greater than the force of the pressure medium acting on the surface of the sealing rings 11 and 12 which seal the annular space 9 and 10 of the feed lines 7 and 8. In the embodiment example, this force is applied by means of permanent magnet rings 23, 24 which are fastened in a hollowed out portion 25, 26 of the cylinder cover 3 and 4. The end faces of the magnet rings terminate with the front wall of the cylinder cover so as to be flush. A soft-iron ring 27 or 28, which is anchored in the piston 2, is located opposite the magnet rings 23, 24. Voltage may be applied to the converters 17, 18 in an alternating manner via the lines 21, 22. In so doing, the piezoelectric disks expand under the influence of the applied electric field with a simultaneous contraction of their diameter in the direction of the longitudinal axis of the cylinder, so that the piston 2 is lifted from the front wall of the cylinder cover. In order to keep the mass of the piston 2 as small as possible it is advantageous to manufacture the piston from a plastic in which the two soft-iron rings 27, 28 are imbedded. A construction in which the permanent magnets are fixed in the piston 2 and the cylinder covers consist of soft iron is also possible.

The cylinder arrangement described above operates in the following manner:

In the drawing, the piston 2 is located in its left-hand stroke end position. It is held at the front wall of the cylinder cover 4 by means of the magnetic field of the ring magnet 24. The pressure line 8 is opened so that the force of the pressure medium rests on the sealing ring 12 of the piston 2. This force is smaller than the magnetic holding force. If the piezoelectric converter 18 receives an electric voltage pulse via the line 22, it expands and lifts the piston 2 somewhat from the front wall of the cylinder cover 4 while the sealing seat 10, 12 opens simultaneously. The pressure of the pressure medium which is fed through the line 8 now acts on the entire piston surfce, i.e. the hydraulic or pneumatic pressure becomes greater than the magnetic holding force. The piston accordingly moves into the right-hand stroke end position, wherein the pressure medium is pressed out on the right-hand piston side via the return line 13. Shortly before reaching the right-hand end position, the return line is closed by means of the piston and the piston speed is decelerated somewhat. When the piston strikes the front wall of the cylinder cover 3, the piezoelectric converter 17 undergoes a deformation. The electric signal which is accordingly produced is sent to the electromagnet 15 via the line 21 and an intermediate amplifier. This electromagnet 15 transports the control slide 16 into its end position, in which the return line 14 and the pressure line 7 are opened and the lines 8 and 13 are closed. The triggering pulse for the movement of the piston 2 in the opposite direction can then be input by means of applying an electric voltage to the converter 17.

The influence of temperature-dependent dimensional changes of the piezoelectric converter can be compensated for by means of applying d.c. voltage to the piezo ceramic. The superposed a.c. voltage signal, which is generated by means of the compression of the converter when the piston strikes the front wall of one of the cylinder covers 3, 4, is utilized as a regulating variable for the electromagnet 15.

We claim:

1. A servocylinder comprising:

a cylinder;

a piston end position transmitter arranged in said cylinder;

a piston reciprocably movable in said cylinder into and out of a stroke end position, said piston end position transmitter being formed to be actuated in response to said piston being in said stroke end position, characterized in that said piston end position transmitter is formed as a piezoelectric converter (17 and 18);

said piston has an end face with a portion (11, 12); and feed means (7, 8) is provided for communicating a pressure medium with said end face of said piston (2), said piston (2) is arranged so that said portion (11, 12) of said end face of said piston (2) seals said feed means when said piston (2) is in said stroke end position; and said piezoelectric converter (17, 18) is expandable to lift said end face of said piston (2) away from said feed means and thereby displace said piston (2) out of said end stroke position.

2. A servocylinder as defined in claim 1, wherein said piezoelectric converter (17, 18) is formed as a cylindrical member, said cylinder having a front wall with a borehole extending in a direction of movement of said piston (2), said cylindrical member being inserted into said borehole.

3. A servocylinder as defined in claim 1, wherein one of said piston and said cylinder is composed of a plastic material with a soft-iron insert (27, 28).

4. A servocylinder as defined in claim 1, wherein said said cylinder has a cover, said piston end position transmitter being arranged at said cover.

5. A servocylinder comprising:

a cylinder;

a piston end position transmitter arranged in said cylinder;

a piston having an end face with a portion and reciprocably movable in said cylinder into and out of a stroke end position, said piston rod position transmitter being formed to be actuated in response to said piston being in said stroke end position, characterized in that said piston end position transmitter is formed as a piezoelectric converter (17 and 18)

feed means (7, 8) is provided for communicating a pressure medium with said end face of said piston (2), said piston (2) is arranged so that said portion (11, 12) of said end face of said piston (2) seals said feed means when said piston (2) is in said stroke end position; and holding means is provided for holding said piston in said stroke end position, said piezoelectric converter (17, 18) is expandable to lift said end face of said piston (2) away from said feed means and thereby displace said piston (2) out of said end stroke position.

6. A servocylinder as defined in claim 5, wherein said holding means includes a soft-iron insert (27, 28) and a permanent magnet (23, 24), one of said piston and said cylinder being formed with said soft-iron insert (27, 28) and the other of said piston and said cylinder being formed with said permanent magnet (23, 24).

7. A servocylinder as defined in claim 5, wherein said piezoelectric converter (17, 18) is centrically arranged in said cylinder.

8. A servocylinder as defined in claim 5, wherein said means for holding said piston includes at least one permanent magnet (23, 24) fastened to one of said cylinder (1) and said piston (2).

9. A servocylinder as defined in claim 8, wherein said permanent magnet (23 and 24) is fastened to said cylinder and forms a portion of said front wall of said cylinder.

10. A servocylinder as defined in claim 5, wherein said cylinder has a front wall, said feed means including a feed line (7, 8) opening in said front wall, said portion (11, 12) of said end face of said piston being arranged to seal said feed line when said piston is in said stroke end position, said holding means being formed to exert a force greater than said a force exerted by the pressure medium when said piston (2) is in said stroke end position, said piston (2) having a displaceable direction when moving out of said stroke end position, said piezoelectric converter (17 and 18) being arranged in said front wall of said cylinder so as to be expandable in said displaceable direction to cause said end face of said piston (2) to lift away from said front wall of said cylinder.

11. A servocylinder as defined in claim 5, wherein said piezoelectric converter (17 and 18) is formed to expand in response to a voltage being applied to said piezoelectric converter (17 and 18).

12. A servocylinder as defined in claim 5, wherein said holding means is formed to exert a holding force so that when said end face of said piston (2) lifts away from said feed means (7, 8) by said piezoelectric converter (17, 18) expanding, the pressure medium exerts a force on all of said end face of said piston (2) that is greater than said holding force.

13. A servocylinder comprising:

a cylinder;

a piston end position transmitter arranged in said cylinder;

a piston reciprocably movable in said cylinder into and out of a stroke end position, said piston end position transmitter being formed to be actuated in response to said piston being in said stroke end position, characterized in that said piston end position transmitter is formed as a piezoelectric converter (17 and 18), and said piezoelectric converter is formed as a joint piezoelectric converter (17, 18) for detecting said piston being in said stroke end position and for lifting said piston (2) away from said front wall of said cylinder.

* * * * *